United States Patent [19]

Kobayashi et al.

[11] Patent Number: 4,566,813

[45] Date of Patent: Jan. 28, 1986

[54] DOT-MATRIX PRINT CONTROLLER

[75] Inventors: Toyohiro Kobayashi; Shoji Mochizuki; Mitsuru Murata; Shunji Tsuboi; Hideto Sakurai, all of Shizuoka, Japan

[73] Assignee: Mitsubishi Denki Kabushiki Kaisha, Tokyo, Japan

[21] Appl. No.: 654,496

[22] Filed: Sep. 26, 1984

[30] Foreign Application Priority Data

| | | | |
|---|---|---|---|
| Sep. 27, 1983 | [JP] | Japan | 58-178487 |
| Oct. 3, 1983 | [JP] | Japan | 58-184617 |
| Oct. 14, 1983 | [JP] | Japan | 58-159009[U] |

[51] Int. Cl.[4] ..... B41J 3/20

[52] U.S. Cl. ..... 400/120; 346/76 PH; 400/22; 400/121

[58] Field of Search ..... 400/22, 54, 120, 121; 346/76 PH; 361/152–154; 178/30

[56] References Cited

U.S. PATENT DOCUMENTS 4,464,669 8/1984 Sekiya et al. ..... 400/120 X

FOREIGN PATENT DOCUMENTS

| | | | |
|---|---|---|---|
| 97545 | 12/1973 | Japan | 400/120 |
| 99688 | 8/1981 | Japan | 400/17 |
| 176181 | 10/1982 | Japan | 400/120 |

OTHER PUBLICATIONS

*IBM Tech. Disc. Bulletin,* B. R. Cavill et al., vol. 24, No. 11A, Apr., 1982, pp. 5430–5432.

*Primary Examiner*—Paul T. Sewell

*Attorney, Agent, or Firm*—Bernard, Rothwell & Brown

[57] ABSTRACT

A dot-matrix print controller having a dot pattern generating means for generating a dot pattern to be printed and a means for supplying current pulses to a dot-matrix print head in accordance with an output of said dot pattern generating means, said controller comprising a counter means for counting the number of dots of a dot pattern to be printed; and a pulse width control means for controlling the width of said current pulses applied to said print head so that the thickness of print is constant.

6 Claims, 15 Drawing Figures

DOT-MATRIX PRINT CONTROLLER

BACKGROUND OF THE INVENTION

The present invention relates to a print controller and, particularly, to a dot-matrix print controller used in a thermal dot-matrix printer using thermo-sensitive paper or a thermal transfer dot-matrix printer.

With the recent rapid advancement in computer technology, various types of printers have been developed, one of which is the thermal dot-matrix printer. Having features of portability, simple structure, low price, low noise, and high quality printing, this printer is most often used as a keyboard printer with print data memory and an electronic typewriter.

The conventional thermal transfer printer with a buffered key-in capability will first be described broadly in connection with FIG. 1. The arrangement shown in block form in FIG. 1 includes a control circuit 1 which controls the overall printer, a keyboard 2 for entering commands and data, a document data memory 3, a display unit 4 using, for example, liquid crystal display (LCD) devices, a drive unit 5 for moving the carriage and platen, a thermal head driver 6, a thermal print head 7, a print pulse generator 8, a carriage feed motor 9, a paper feed motor 10, a head retracting plunger 11, a character generator (CG) ROM 12 storing font data, and a voltage stabilizing capacitor 13 connected between the thermal print head 7 and the power source.

The conventional thermal transfer printer with a buffered key-in capability arranged as mentioned above has some deficiencies in its print quality. The following describes the operation in which in response to the key entry of data "A", font data configured in a m-by-n dot matrix is printed in to milliseconds for each dot. In FIG. 1, the control circuit 1 responds to the key entry on the keyboard 2 to display the entered data on the display unit 4 and also stores it in the memory 3. When the printer is operated in direct print mode, the control circuit 1 makes access to the character generator (CG) ROM 12 addressed in accordance with the input data, prints the leftmost column of the m-by-n dot matrix by operating the head driver 6 in a duration of to milliseconds, and then operates on the carriage feed motor 9 to feed the carriage for one pitch rightward. These operations are repeated so that a complete m-by-n font is printed.

The aforementioned conventional print system, however, lacks in the uniformity of thickness of the print. The reason of this problem will be explained in the following.

The thermal transfer printer with the buffered key-in capability operates in different print speed in direct print mode in which a keyed character is printed immediately and in memory print mode in which keyed characters are once stored in the memory and then printed. In direct print mode, an unskilled typist will type as slow as one character per second, i.e., at a print speed of 1 cps, while a skilled typist will type as many as 10 characters per second, i.e., at a print speed of 10 cps. On the other hand, in memory print mode, in which data stored in the memory 3 are printed, characters are printed at a speed as high as 10–50 cps. On this account, during a continuous high-speed printing, successive drive pulses of a constant pulse width to causes a cumulative heating of the print head as shown in FIG. 2, resulting in an increased thickness of the print, and eventually in a transfer of image of inactive printing elements, so called "tracing". In addition to such degraded print quality, the print head can be deteriorated due to overheating. In FIG. 2, hatched portions indicate the time length for printing one character.

Furthermore, in controlling the drive of printing elements having a resistance of R, energy ($v^2/R\ t$) supplied to each element needs to be kept constant. For this purpose, it is a general convention to employ a large stabilizing capacitor 13 or a stabilized power supply in order to cope with the variable number of active elements, resulting in a bulkiness of the printer.

Some of the conventional dot-matrix printer of the serial print type have a capability of printing characters with underline. In these cases, the character printing elements and underline printing elements are arranged substantially equidistantly, and connected to the character printing elements and print signal terminals. Other ends of the character printing elements and underline printing elements are connected to the common line. On this account, in printing character "A" and an underline simultaneously, they can be printed clearly separated, whereas in printing characters "y" and "p" (lower case) with underline, the characters link with the underline, resulting in a degraded print. This linkage problem also occurs in printing lower-case characters "j", "q" and "g" with underline. This problem may be overcome by providing the conventional print head with additional printing elements so that these characters are spaced out from the underline. However, such an arrangement wastes many printing elements, and causes an imbalanced font of characters.

SUMMARY OF THE INVENTION

Accordingly, it is a primary object of the present invention to provide a dot-matrix print controller which yields the improved print quality.

Another object of this invention is to provide a dot-matrix print controller which maintains the thickness of print independently of the print speed.

Still another object of this invention is to provide a dot-matrix print controller which achieves a constant energy application per dot without using a large stabilizing capacitor, thereby allowing compact design.

Further object of this invention is to provide a dot-matrix print controller with a print head which provides better visibility for underlined characters.

In order to achieve the above objectives, the inventive controller estimates the cumulative heating of the print head by counting the number of dots of a printed character and determines the width of pulse applied to the elements of the print head depending on the amount of cumulative heating.

According to one form of this invention, there is provided a dot-matrix print controller having a dot-pattern generating means for producing a dot pattern to be printed, and a drive means for supplying current pulses to the elements of the print head in accordance with the output of the dot pattern generating means, wherein the controller is provided with a counter means for counting the number of dots of a dot pattern to be printed, and a pulse width control means for controlling the width of current pulses supplied to the print head so that the thickness of print is constant.

DESCRIPTION OF THE PREFERRED EMBODIMENTS

Figure 1:
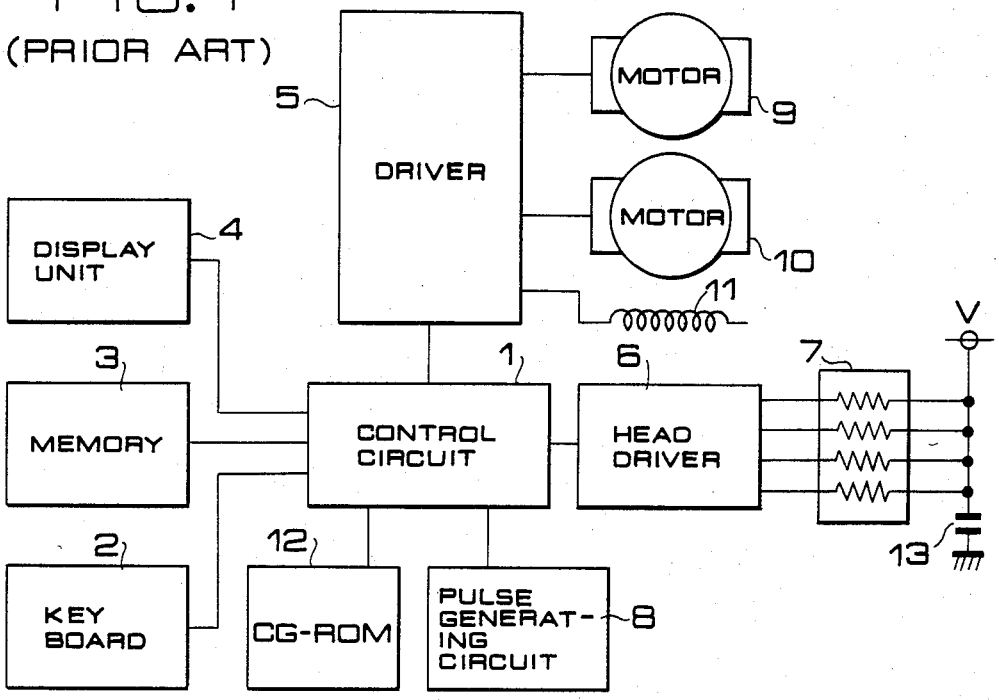
FIG. 1 (PRIOR ART)
FIG. 1 is a block diagram showing the basic arrangement of the conventional print controller of the thermal transfer printer with the buffered key-in capability.
Figure 3:
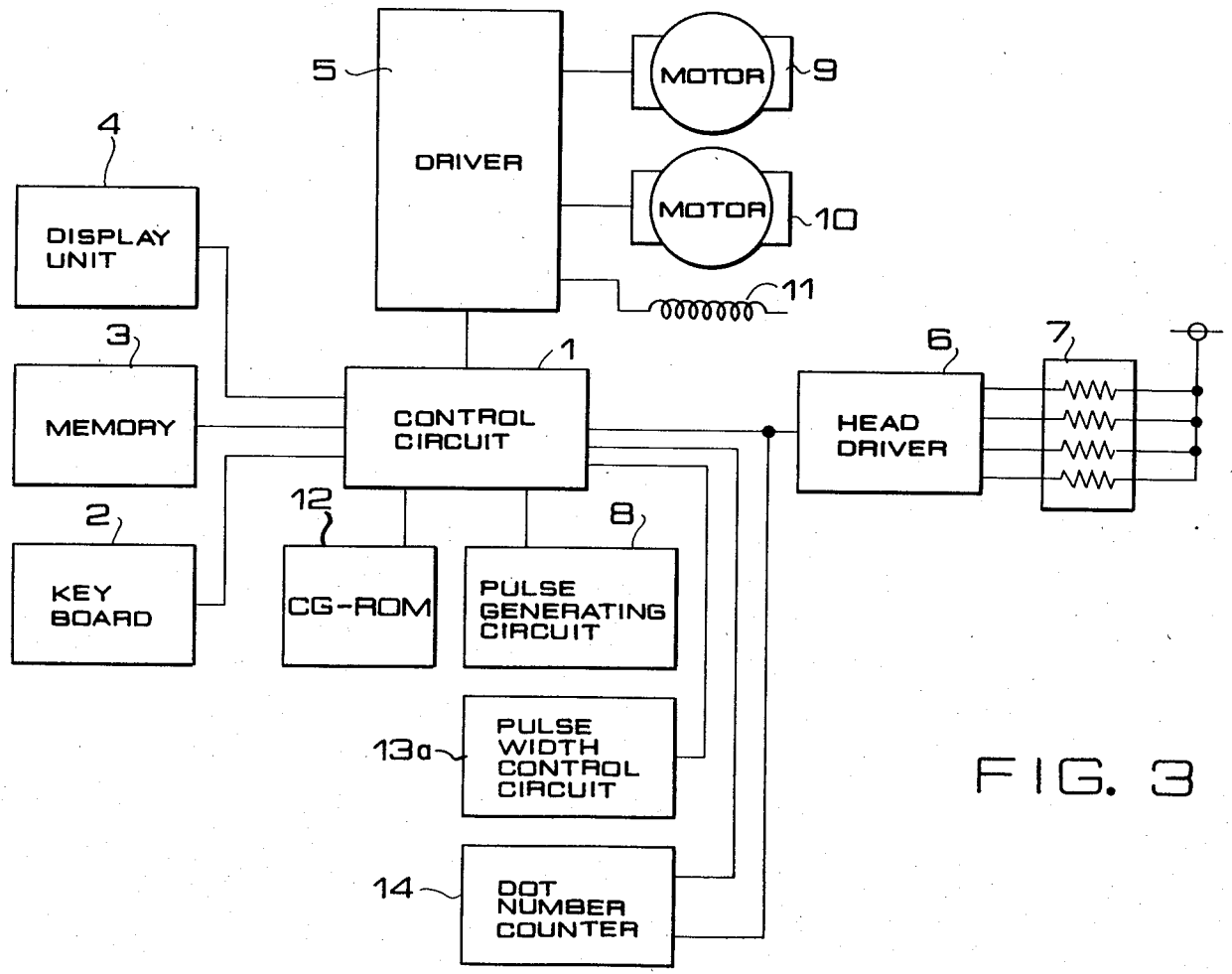
FIG. 3 is a block diagram showing an embodiment of the inventive print controller of the thermal transfer printer with the buffered key-in capability.

In FIG. 3 showing an embodiment of this invention, component blocks 1 through 12 are exactly the same as those referred to by the common reference numbers in FIG. 1, and explanation thereof will be omitted. The arrangement of FIG. 3 further includes a pulse width control circuit 13*a* for controlling the width of the current pulse applied to the print head, and a dot counter 14 which counts the total number of dots used to print one character. Both of the pulse width control circuit 13 and dot counter 14 are connected to the control circuit 1.

Next, the operation of the inventive print controller will be described in detail in connection with the flowcharts shown in FIGS. 4 and 5. In FIG. 5, variable DOT represents the total number of dots used in one character.

Figure 4:
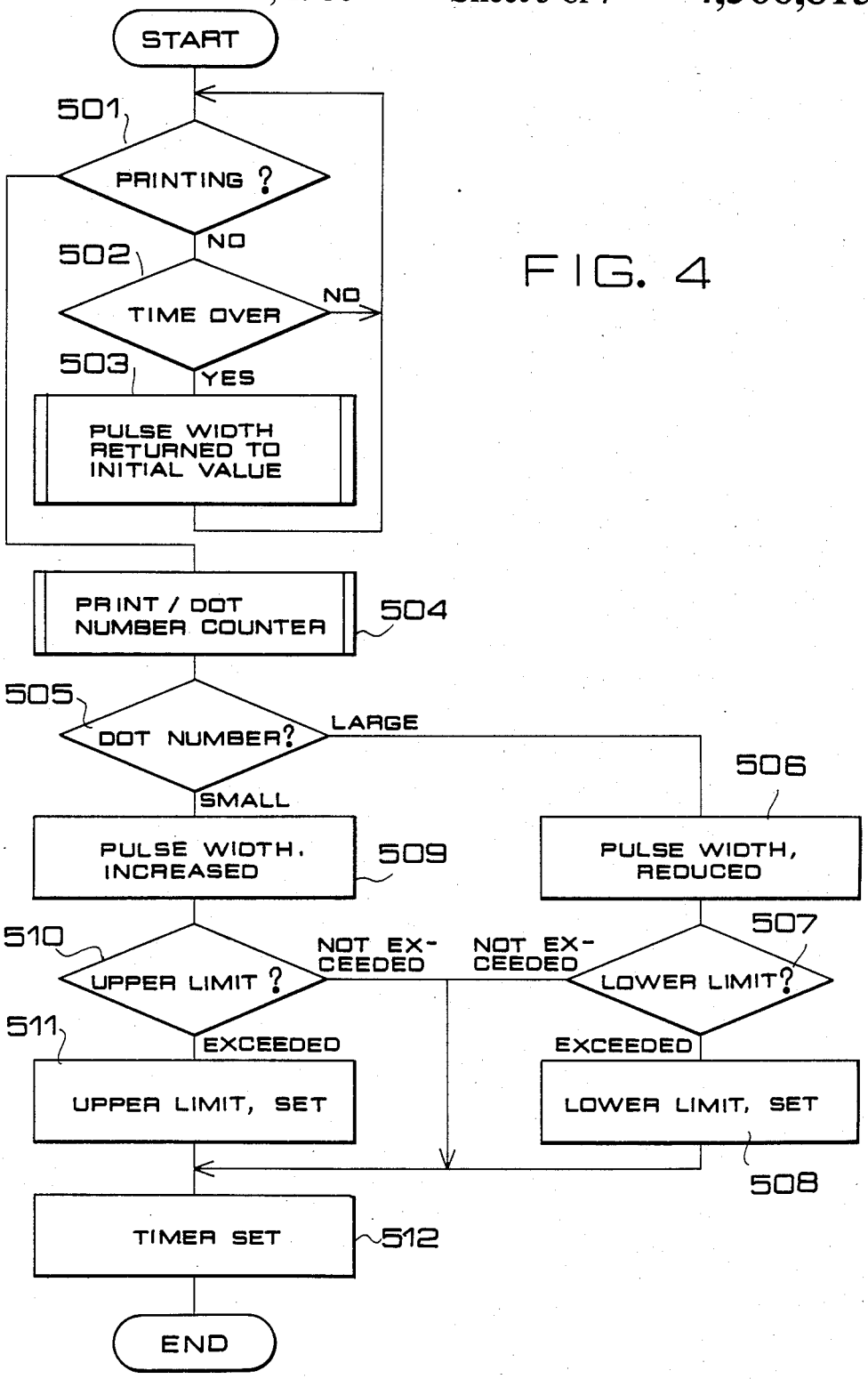
FIGS. 4 and 5 are flowcharts used to explain the operation of the print controller shown in FIG. 3.
Figure 5:
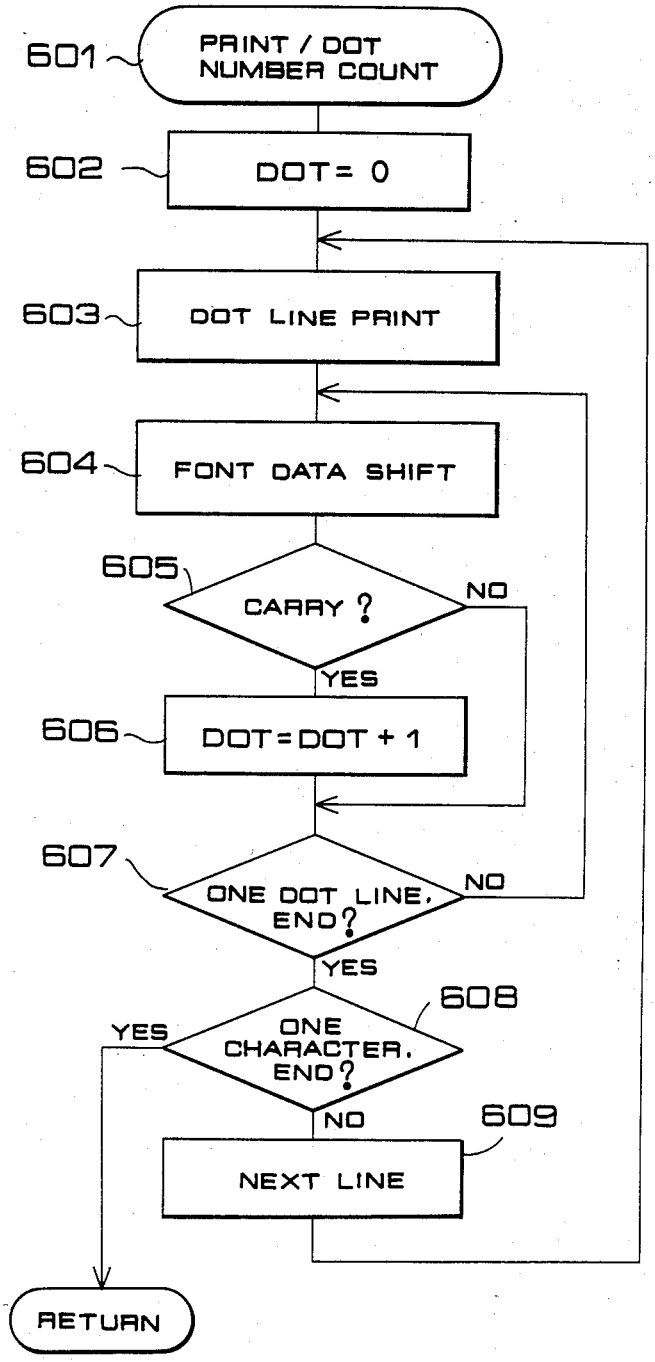

Steps 501 and 502 in FIG. 4 check whether or not the print signal is issued within a certain time interval. If the print signal is not entered, the pulse width is set to the initial value in step 503, or if the print signal is entered, control is transferred to step 504 in which the total number of dots for one character is counted and it is printed by steps 601–609 as shown in the flowchart of FIG. 5. In steps 504 and 505 of FIG. 4, the number of dots is checked and if it is larger than the specified value, as in the cases of complex characters such as "鷺", "懸" and "蹴", the print head is much heated due to the considerable amount of power applied to it, and on this account, the pulse width for a character printed next is reduced in step 506. The pulse width goes on decreasing and when it has fallen below the lower limit, control branches from step 507 to step 508 in which the pulse width is set to the lower limit. If, on the other hand, the number of dots is found smaller in step 505, as in the cases of printing simple characters such as "ノ|\" and "0", the print head is cooled, and the pulse width for a character printed next is increased in step 509. Similarly to step 507, step 510 checks the increasing pulse width and it is set to the upper limit in step 511 when it exceeds the upper limit. The process completes by setting the timer in step 512.

Figure 2:
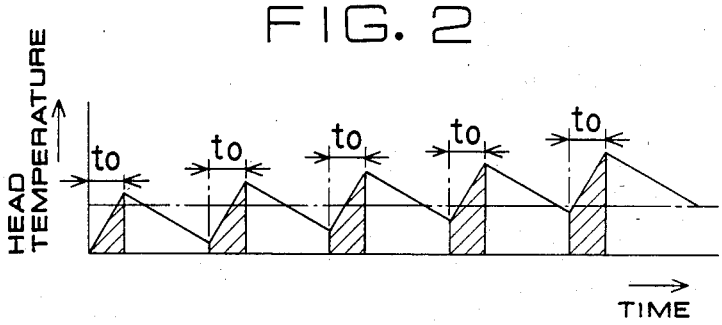
FIG. 2 is a graph of the print head temperature plotted against time, as a result of the conventional print controller.
Figure 6:
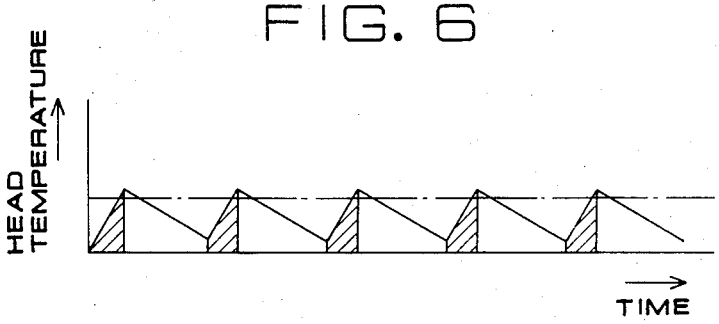
FIG. 6 is a graph of the print head temperature plotted against time, as a result of the inventive print controller.

FIG. 6 shows the variation of the print head temperature as a result of control according to the present invention. Hatched portions indicate the pulse width for printing one character. As can be seen from the comparison of FIG. 6 with the result of the conventional control shown in FIG. 2, the head temperature is maintained within a certain range in the case of FIG. 6.

Although in the foregoing embodiment the controller is arranged by adding the pulse width control circuit 13*a* and dot counter 14 to the control circuit 1 and pulse generating circuit 8, the functions of these four circuits can be accomplished by a single microcomputer without increasing the number of component parts, but merely by preparing the program, and this arrangement allows cost reduction and easiness of modification of specifications.

Figure 7:
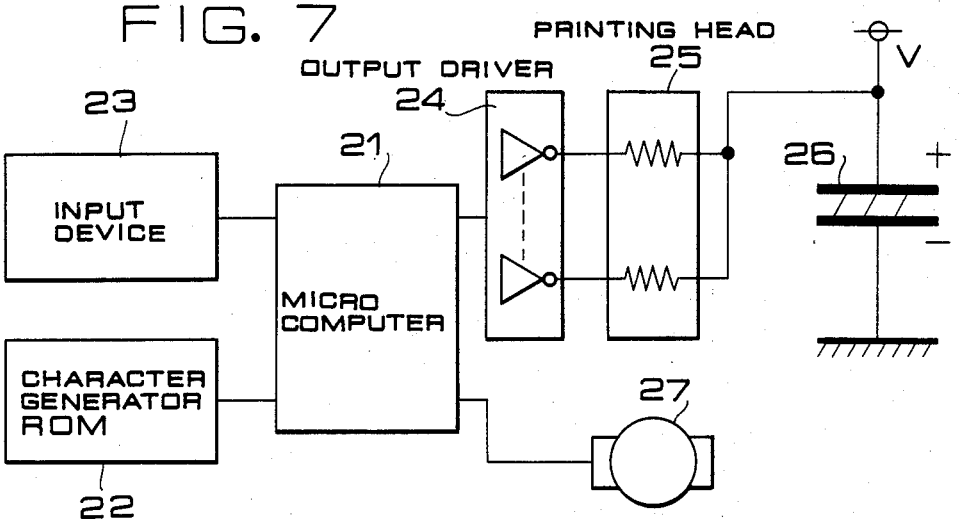
FIG. 7 is a block diagram showing a modified arrangement of the print controller employing a microcomputer.
Figure 9:
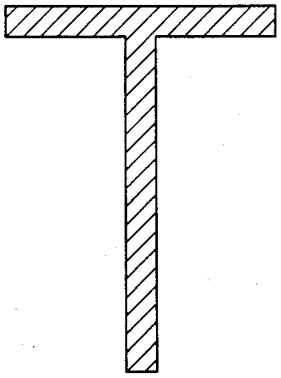
FIGS. 9(*a*) and 9(*b*) are diagrams showing a character and its font data stored in the character generator ROM.
Figure 9:
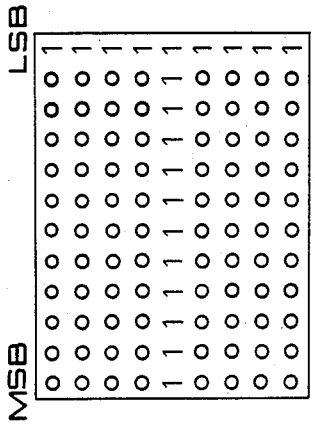
Figure 10:
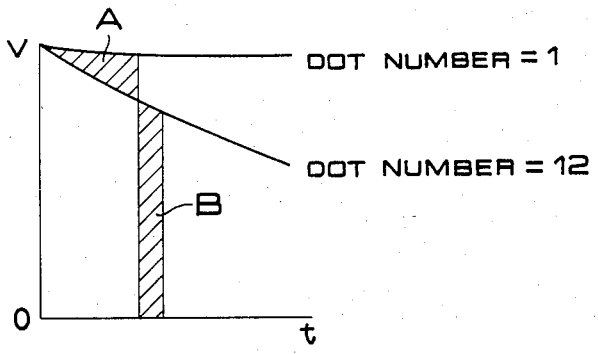
FIG. 10 is a graph showing the voltage vs. time characteristics plotted in two different numbers of dots of print.
Figure 8:
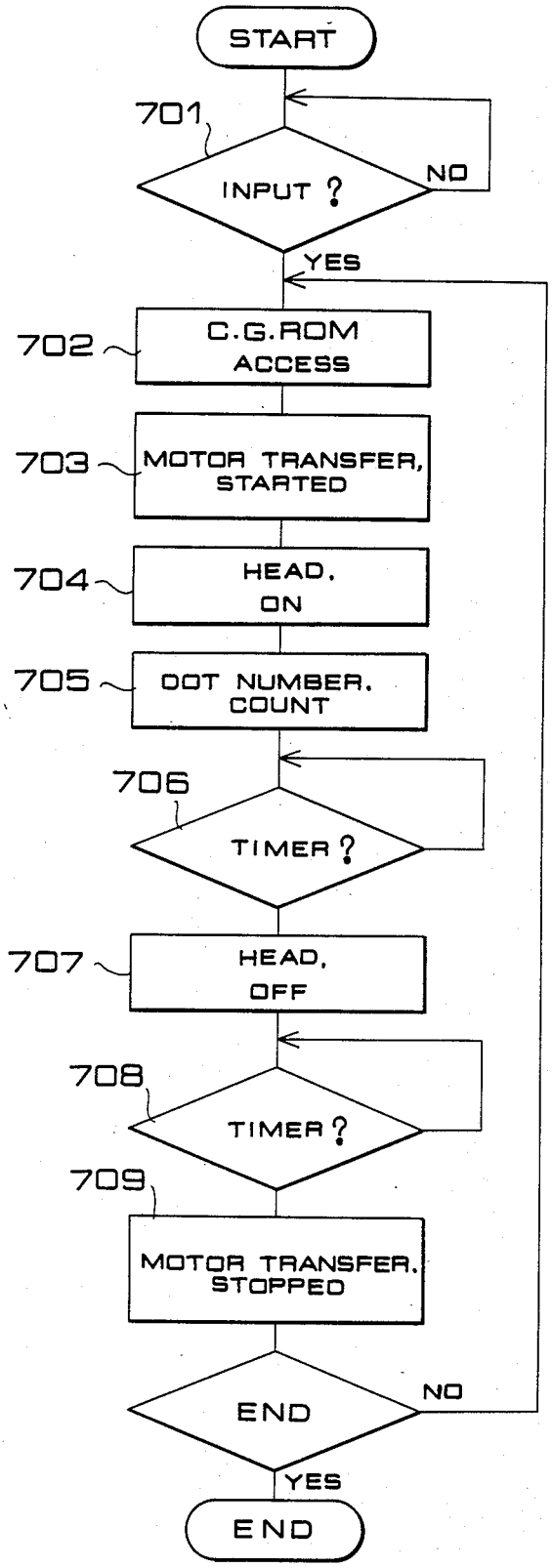
FIG. 8 is a flowchart used to explain the operation of the print controller shown in FIG. 7.

FIG. 7 shows an embodiment of the print controller using a microcomputer, FIG. 8 shows in a flowchart the operation of the print control system shown in FIG. 7, FIG. 9 shows a print character in the dot matrix configuration, and FIG. 10 shows the relationship of the application voltage with time for different numbers of dots for printing. The microcomputer 21 performs overall control including dot count and pulse width control. The character generator (CG) ROM 22 stores font data which are read out by being addressed in correspondence to each character. For example, for character "T" shown in FIG. 9(*a*), font data shown in FIG. 9(*b*) is stored in the ROM 22. The input unit 23 comprises a keyboard matrix or an interface unit for receiving print data from the external equipment. The output driver 24 is made up of a transistor array, and the print head 25 is the assembly of heating resistor elements.

As shown in the flowchart of FIG. 8, on receiving print data "T" in ASCII code or the like in step 701, the microcomputer 21 makes access to the character generator ROM 22 in step 702 to fetch data 001 (hexadecimal) for the first dot line. Next, in step 703, the head motor 27 is activated to start the print head 25 moving, and in step 704 the font data 001 is supplied to the output driver 24, which energizes the print head 25. The number of dots is counted in step 705, and when the pulse width reaches $t=t_0+t_1$ ($t=t_0+t_1n$, where n is the number of dots) in consideration of the voltage drop shown in FIG. 10, the microcomputer 21 halts the pulse output in step 707, and, following the time count of a few milliseconds in step 708, brings the motor 27 to a stop in step 709. The process returns to step 702, and the successive data 001, 001 and 001 are printed in the same way as above. Subsequently, data FFF is outputted to the print head 25, and the pulse output is terminated on expiration of $t=t_0+12t_1$. Then, data 001, 001, 001 and 002 are outputted sequentially while moving the print head 25, and printing of character "T" is completed.

FIG. 10 shows the relationship between the drive voltage and application time for printing different numbers of dots. Section A is an area of lacking print energy due to the voltage drop caused by the increased number of dots, and this section is supplemented by energy of area B which is obtained by increasing the application pulse width, thereby providing a constant power to each element irrespective of the voltage drop.

Figure 11:
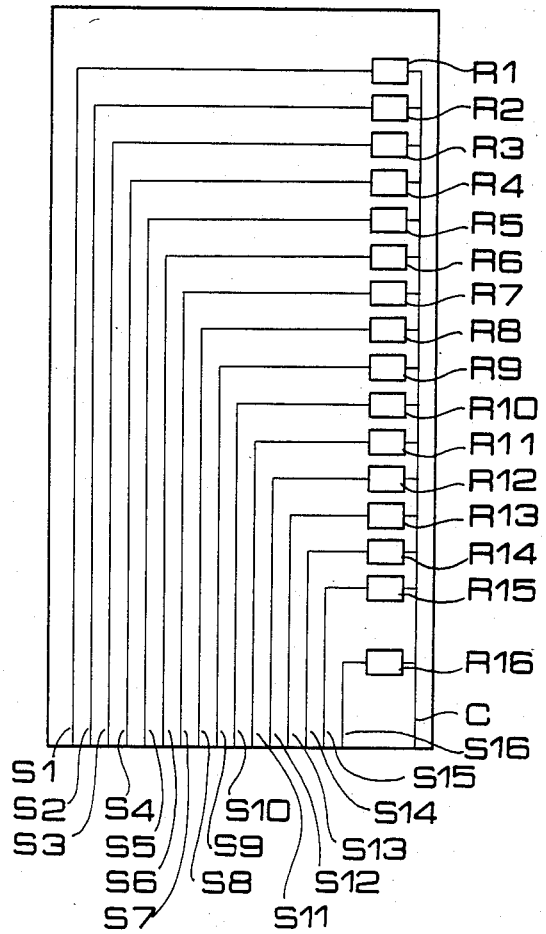
FIG. 11 is a diagram showing an embodiment of the print head providing an improved visibility for underlined characters.

FIG. 11 shows an embodiment of the improved thermal print head for preventing a printed character from overlapping the underline. In the figure, reference numbers S1–S16 denote terminals of the print signals, C denotes a common drive line, R1–R15 denote thermal elements placed equidistantly for printing characters, and R16 denotes a thermal element placed more distantly from the neighboring element, e.g., by the amount of a dot interval, than the pitch of the character printing elements.

One end of each character printing elements R1–R15 is connected to respective one of the print signal terminals S1–S15, and one end of the underline printing element R16 is connected to the print signal terminal S16. Other ends of the character printing elements R1–R15 and underline printing element R16 are connected to the common line C.

Figure 12:
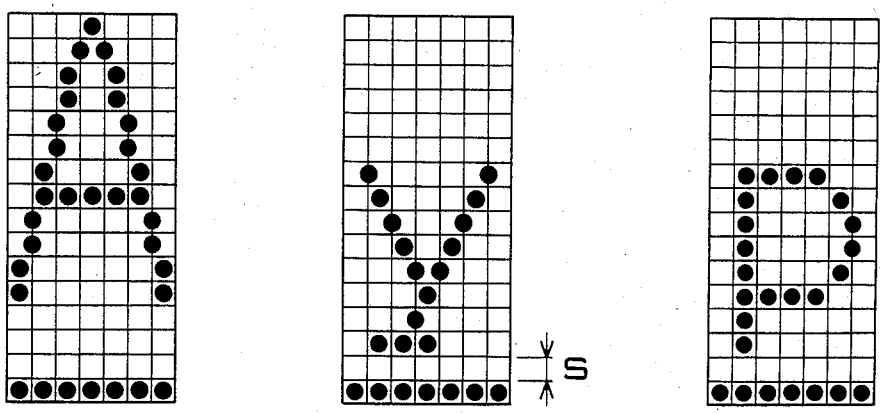
FIGS. 12(*a*), 12(*b*) and 12(*c*) are examples of print produced by the print head shown in FIG. 11.

FIGS. 12(*a*) through 12(*c*) show examples of print produced by the print head shown in FIG. 11. The character printing elements R1–R15 are the same as the conventional print head. By interposing a space S between the character printing element R15 and the underline printing element R16, underlined characters much visible as shown in FIGS. 12(*a*) through 12(*c*) can be printed through the same control as used conventionally.

Although an embodiment of the thermal print system has been described, the same effect is of course achieved for the thermal transfer print system and wire impact print system.

According to the inventive print controller, as described above, which is provided with the dot counter and pulse width control circuit so that the application pulse width is controlled depending on the number of dots of print, the problem of cumulative heating of the print head is solved and a high quality print can be obtained independently of the print speed.

According to this invention, printing energy applied to each element can be stabilized without the use of a large voltage stabilizing capacitor, but by applying a pulse with a duration determined from the count of dots of a printed character, whereby high quality printing can be attained. The use of a small voltage stabilizing capacitor allows compact design and also cost reduction for the printer.

Moreover, the inventive print head, in which the underline printing element is spaced apart from the neighboring character printing element, improves the visibility of underlined characters merely by replacing the conventional print head.

What is claimed is:

1. A print controlling for a dot-matrix printer having a keyboard for entering characters to be printed, a memory for storing temporarily print data entered through said keyboard, a display unit for displaying the contents of said memory, a pulse generating circuit for generating current pulses applied to a print head, a dot-matrix thermo-sensitive print unit and a control circuit for controlling said memory, display unit, pulse generating circuit and print unit, said print unit having an operational mode of printing a keyed-in character immediately and an operational mode of storing keyed-in characters in said memory and printing the stored characters continuously, said print controller further comprising a counter for counting the number of dots of one character in accordance with the print data stored in said memory, and a pulse width control means for reducing the width of the pulse applied to said print head when the count value of said counter is large and incressing the width of the pulse applied to said print head when the count value of said counter is small in order to make the thickness of printing constant, and said pulse width has an upper limit and a lower limit for control of increasing or decreasing the width of the applied pulses.

2. A print controller according to claim 1, wherein said control is performed by a microcomputer.

3. A print controller according to claim 1, wherein said print controller performs printing by application of pulses to thermal resistor elements of said print head in accordance with stored print data, and said pulse width control means counts the number of dots of a dot line of one character to be printed and applies pulses with their pulse width corresponding to the number of dots to said print head.

4. A print controller according to claim 1, wherein character printing elements and underline printing element of said print head are separated by interposition of a clear space between the character printing elements and the underline printing element.

5. A print controller according to claim 1, wherein said pulse width control means provides gradually increasing or decreasing control until the upper limit or lower limit is reached.

6. A print controller according to claim 1, further comprising a timer which counts the time after completion of the print operation and outputs the signal when the time reaches a predetermined value, and said pulse width control means receiving the output of said timer so as to set said applied pulse width at a predetermined setting value.

* * * * *